US005134828A

United States Patent [19]

Baur

[11] Patent Number: 5,134,828

[45] Date of Patent: Aug. 4, 1992

[54] CONNECTION FOR JOINING PRECAST CONCRETE PANELS

[75] Inventor: Kenneth C. Baur, Mohnton, Pa.

[73] Assignee: High Industries, Inc., Lancaster, Pa.

[21] Appl. No.: 624,819

[22] Filed: Dec. 14, 1990

[51] Int. Cl.[5] ..... E04B 1/38

[52] U.S. Cl. ..... 52/704; 52/699

[58] Field of Search ..... 52/295, 698, 699, 704, 52/707, 587; 405/259, 260, 261, 262

[56] References Cited

U.S. PATENT DOCUMENTS

| | | | |
|---|---|---|---|
| 1,645,903 | 10/1927 | Garber . | |
| 1,670,443 | 5/1928 | Fishel et al. | 52/698 |
| 2,194,718 | 3/1940 | Older | 94/18 |
| 2,500,262 | 3/1950 | Parrott | 94/8 |
| 2,554,415 | 5/1951 | McGregor | 52/699 |
| 2,616,284 | 11/1952 | Leontovich | 52/295 |
| 2,948,995 | 8/1960 | Cogan | 52/587 |
| 3,430,408 | 3/1969 | Dean | 52/699 |
| 3,500,607 | 3/1970 | Wilson | 52/699 |
| 3,744,208 | 7/1973 | Spanel | 52/706 |
| 3,867,804 | 2/1975 | Wilson | 52/699 |
| 4,117,643 | 10/1978 | Lamothe | 52/699 |
| 4,170,853 | 10/1979 | Kohaut | 52/99 |
| 4,198,798 | 4/1980 | Haydock | 52/699 |
| 4,211,048 | 7/1980 | Naka | 52/700 |
| 4,316,677 | 2/1982 | Ciavatta | 405/259 |
| 4,578,916 | 4/1986 | Witschi | 52/396 |
| 4,642,964 | 2/1987 | Kellison | 52/699 |
| 4,773,794 | 9/1988 | Harke | 52/704 |
| 4,840,524 | 6/1989 | Bisping et al. | 52/704 |

*Primary Examiner*—Michael Safavi
*Attorney, Agent, or Firm*—Thomas Hooker

[57] ABSTRACT

A connection for joining upper and lower precast concrete panels includes a molded plastic tubular body having closed ends and recesses formed in the inside and outside of the body. The body is cast into the top of the lower panel with a sheet in place closing one end to prevent entry of water and debris into the interior of the body. When the panels are erected, the sheet is broken open exposing the interior of the body, the body is filled with grout and a structural rod extending down from the upper panel is lowered into the body as the upper panel is placed on the lower panel. Setting of the grout forms a strong connection between the two panels.

21 Claims, 2 Drawing Sheets

FIG. 3
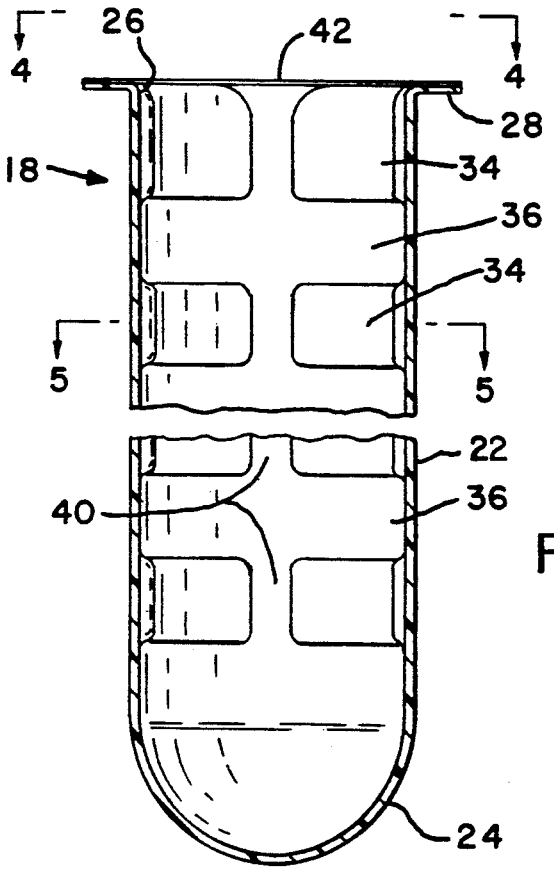
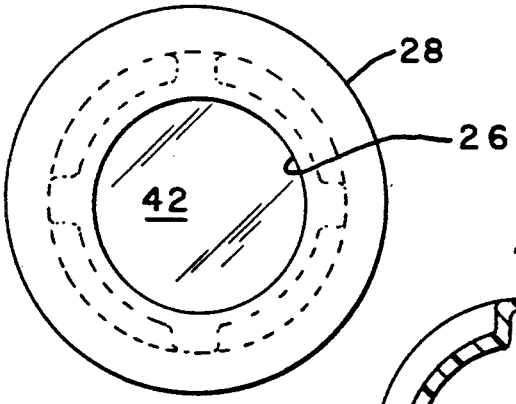
FIG. 4
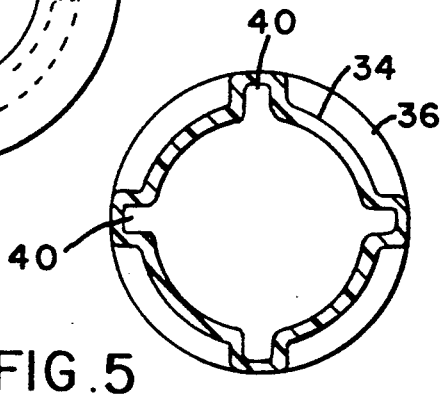
FIG. 5
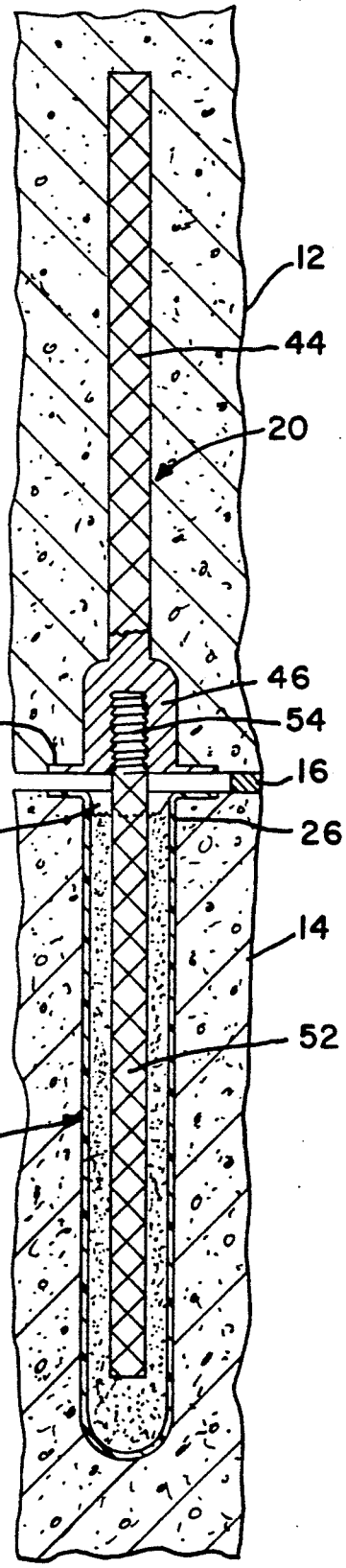
FIG. 6

CONNECTION FOR JOINING PRECAST CONCRETE PANELS

FIELD OF THE INVENTION

The invention relates to connections for joining together precast concrete members such as panels or columns stacked one on top of the other to form building walls. These walls may be used in structures such as office buildings, parking garages, manufacturing plants and the like. The connections are concealed within the thickness of the panels or columns so that they do not interfere with the exterior appearance of the member.

DESCRIPTION OF THE PRIOR ART

Conventional connections joining cast concrete wall panels use metal spiral tube sections cast into the top of the lower panel. These tube sections are mounted on the framing member at the top of the top wall in the form used to cast the panel. Tape is used to close the bottom of the spiral tube sections. After pouring of the concrete panel and setting of the concrete, the forms are removed and the open ends of the tubes are sealed and taped, or alternatively a plug is driven into the tube.

A lower panel with conventional spiral tubes cast in place is erected and the tubes are opened and filled with mortar. An upper panel with structural rods extending downwardly from the lower surface of the panel above the tubes is lowered onto shims with the rods extending into mortar placed in the opened tubes. The mortar sets to form a joint between the two panels.

It is difficult to secure the spiral tube used in the conventional joint to the forms used for pouring a lower panel. The taped seal at the inner end of the tube may leak allowing cement to flow into the interior of the tube during casting of the lower panels.

The tape and plug seals used to close the tube sections are ineffective and frequently allow water and dirt to collect in the tubes prior to erection of the panels. If the water in the tube freezes there is a risk that resultant expansion will crack and ruin the panel. Any debris collected within the tube will degrade the quality of the connection formed when the panels are erected. The sharp corner in the concrete at the bottom of the tube concentrates stress in the cast panel and can lead to cracking of the panel.

SUMMARY OF THE INVENTION

The connection of the present invention reliably joins together precast concrete members such as panels and columns. While the following disclosure refers to precast concrete panels, it is understood that the invention may be used to join columns and other types of precast concrete members.

Precast panels are joined according to the invention using a filled tube member cast in the upper surface of a lower panel. This member has an elongate imperforate body with recesses on the outside and inside of the body for forming strong connections with the cement surrounding the outside of the body and the mortar placed in the body during erection of the panels. A seal covers the end of the body at the top of the panel and assures that the interior of the tube is kept free of debris and water during molding and the interval from molding until the panel is erected. The seal may be transparent to permit visual inspection of the interior of the tube and confirmation that water and debris have not entered the tube member. It may be adhered to the flange at the top of the member or may be an integral part of a blow molded member.

When the wall is erected the lower panel is positioned in the vertical position and the seal is opened to permit filling of the tube with mortar. Rods extending down from the upper panel are then lowered into the filled tube to form the connection between the two panels.

The lower end of the body is smoothly rounded and includes smooth walls extending upwardly a distance above the end. In the unlikely event a small amount of water should seep into the body, collect at the lower end of the tube below the interior recesses, and freeze and expand, the rounded interior surface lifts the ice vertically reducing the risk that the freezing of the water will crack the panel. The rounded end forms a rounded recess in the surrounding concrete which does not concentrate stress and reduces the likelihood of stress cracking in the concrete at the lower end of the body.

Other objects and features of the invention will become apparent as the description proceeds, especially when taken in conjunction with the accompanying drawings illustrating the invention, of which there are two sheets and one embodiment.

DESCRIPTION OF THE DRAWINGS

FIG. 3 is a longitudinal sectional view taken through the tube member, partially broken away;

FIGS. 4 and 5 are views taken along lines 4—4 and 5—5 respectively of FIG. 3; and FIG. 6 is enlarged sectional view showing the connection.

DESCRIPTION OF THE PREFERRED EMBODIMENT

Figure 2:
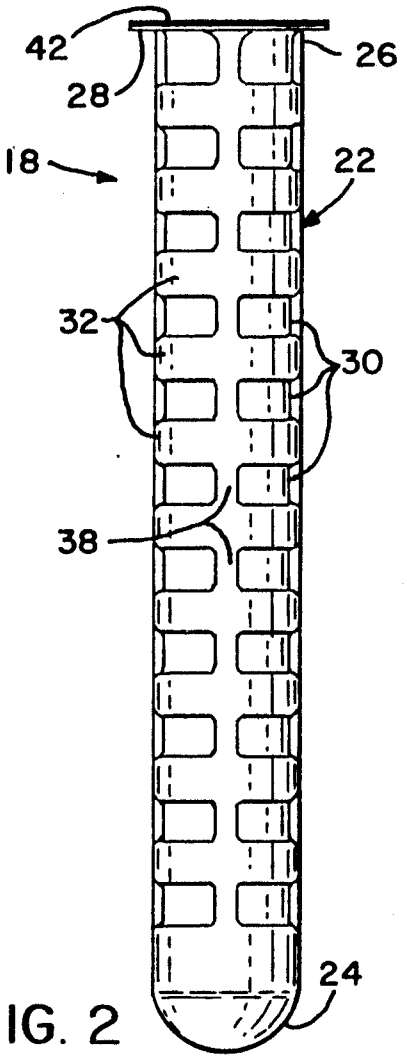
FIG. 2 is a side view of a tube member used in the connection.
Figure 1:
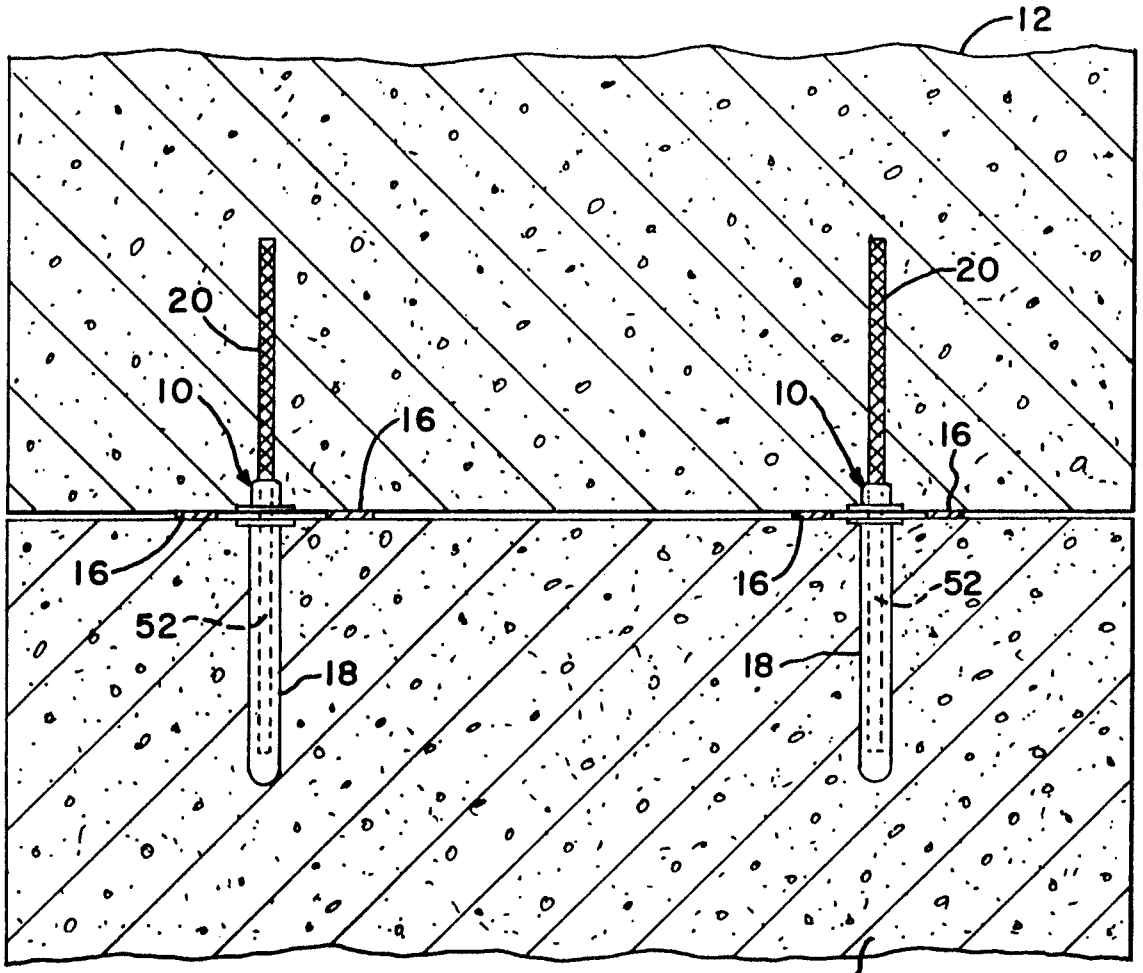
FIG. 1 is a sectional view taken through the thickness of two precast concrete panels showing two connections according to the invention.

Connection 10 shown in FIG. 1 is used to make a concealed joint between a thin upper precast concrete panel 12 and a thin lower precast concrete panel 14. Shim plates 16 are spaced between the panels and bear the weight of the upper panel. Connections 10 prevent relative shifting or bending of the panels.

Each connection 10 includes a hollow tube member 18 embedded in the concrete at the top of the lower panel 14 and a two-part rod member 20 embedded in the upper panel 12. The lower portion of the rod member 20 extends into the tube member and is held in place in the tube member by grout which is flowed into the tube member prior to insertion of the rod member. The concrete in the lower panel 14 engages recesses on the outside of the tube member to secure the member to the panel. The grout in the tube member extends into recesses in the inside of the member and engages the rough surface of the rod member to form a strong connection between the two panels.

FIGS. 2 through 5 illustrate the tube member 18 prior to being cast into the lower panel member. Member 18 includes a rigid tubular body 22 having opposed ends 24 and 26. The body 22 is preferably blow molded from thermoplastic resin with a closed, rounded end 24. An integral circumferential nail flange 28 extends outwardly of the body at end 26. Flange 28 extends completely around the end 26. A plurality of rectangular shaped inwardly extending recesses 30 are formed in the outside of body 22. Groups of four recesses extend completely around the body at locations spaced along its length and are separated by smooth circumferential walls 32.

Body 22 is preferably blow molded from relatively uniform thickness plastic so that the recesses 30 on the outside of the body form smooth inner walls 34 on the inside and the walls 32 on the outside form circumferential recesses 36 on the inside of the body. See FIG. 3. The vertical smooth walls 38 joining walls 32 on the outside of the body form vertical recesses 40 on the inside joining circumferential recesses 36. The blow molded body 22 is imperforate and waterproof.

End 26 may be sealed closed by a sheet of transparent plastic 42 which may be adhered to the upper surface of flange 28 using an appropriate adhesive (not illustrated). The adhesive forms a waterproof seal between the window and the flange thereby closing the interior of the tube member 18 against moisture, water and dirt. Sheet 42 is adhered to the flange 26 during manufacture of the tube member 18, prior to embedding of the member into the lower panel 14. Alternatively, the end 26 may be sealed closed by a plastic sheet blow molded integrally with body 22. Other types of seals may be used.

In one application, the tube member may have a maximum diameter of about 3½ inch, a length of about 24 inches and is located midway between the sides of a panel having a thickness of about 18 to 12 inches. The recesses on the inside and outside of the tube member have a depth of approximately 5/16 inch. The tube member may be molded from high density polyethylene or other suitable plastic resin and may have a wall thickness of about 0.080 to 0.100 inch.

Two-part rod member 20 includes a rod 44 embedded in the upper panel member 12 and carrying a threaded nut 46 opening at the lower surface of the panel as shown in FIG. 6. Mounting flange 48 surrounds the lower end of the nut 46.

Lower panel 14 is cast conventionally using appropriate-size wooden or metal forms, concrete and reinforcing bars. When the forms are readied for pouring, a number of tube members 18 are nailed to the member defining the top wall of the panel, using finishing nails or other fasteners driven through the flange 28 and the overlying edge of the plate 42 in order to removably hold the tube member in place on the side of the form. The tube member extends into the form and is preferably located midway between the top and bottom of the form.

After the appropriate number of tube members have been nailed to the form reinforcing bars are placed in the form and concrete is flowed into the form. The concrete surrounds the tube member 18 and fills the recesses 30. The imperforate body 22 and plate 42 prevent the concrete from entering the interior of the hollow member.

The recesses in the tube member stiffen the member and prevent the pressure of liquid concrete flowed into the mold from crushing the tube member. This pressure may, depending upon the depth of the member in the mold, be as great as 450 pounds per square foot.

After the concrete in the form has set to form the panel, the form is stripped away pulling out the nails previously holding the flanges to the top wall form and leaving the window sheets 42 bonded to the flanges 28 and exposed on the top wall of the panel 14.

Before casting of the upper panel 12 rods 44 are nailed to the mold framing the lower wall of the panel at locations opposite the tube members in the lower panel. The rods are secured to the framing using nails driven through flanges 48. The upper panel is teen poured and surrounds rods 44 to form connections between the concrete in the panel and the rough exterior of the rods. After pouring and setting of the concrete in the panel, the framing is stripped away from the panel. Both cast panels may be stored at the manufacturing site or shipped to the job site as required.

Following casting of the lower panels 12 sheets 42 seal the interior of the tube members 18 and prevent water, moisture or debris from entering the interior of the members. Preventing water from entering the member is particularly important because water collected in the tube, when frozen, expands and could crack and ruin the panel. Debris or moisture collected within the panel could prevent forming a proper strong joint between the mortar and the body 22. The sheet 42 is transparent and serves as a window to permit a worker to inspect the interior of the tube member visually and verify that the interior has remained empty and clean during the interval between casting of the lower panel and opening the sheet to receive grout when the lower panel is erected and joined to upper panel 12. After casting, panel 14 may be stored for a relatively long time before it is transported to a job site and erected.

Panels 12 and 14 are erected by first positioning panel 14 vertically in a desired location with cast-in-place tube members 18 facing upwardly and opening on the top wall of the panel. Before erecting the panel a worker visually inspects the interior of the tubes through the windows 42 to assure that the bodies 22 are olean and empty. With the panels in the upright position workmen open the upper ends of the tubes. In tubes in using windows 42, the windows may be physically removed by first puncturing the sheet and then tearing the windows away from the flanges. Alternatively, the windows may be cut away or, in some circumstances, ruptured and bent down into the interior of the tubes. In tubes closed by integral seals, the seals may be cut or burned off. Burn-off is easily accomplished using a torch of the type commonly used when erecting concrete structures. Alternatively, the integral seal may be ruptured in place as previously described.

Opening of the seal may injure the portion of the tube member cast in the concrete panel. Such injury is incidental to the operation of the connection since once the tube member is opened there is no longer a need to maintain a sealed body. After the members 18 have been opened, a grout mixture is poured into the open tube members and flows into the interior recesses 36 and 40.

Prior to placing panel 12 on panel 14 reinforcing rods 52 with threaded ends 56 are threadably secured into nuts 46 so that the rods 52 extend outwardly from the upper panel 12. Shim plates 16, which may be ½ inch thick plates measuring six inches on the side, are placed in the upper surface of the lower panel 14 at appropriate locations. The upper panel is then raised above the lower panel with each rod 52 positioned above a tube member 18. The upper panel is carefully lowered down on top of the lower panel so that each rod 52 extends down into a grout-filled tube member until the upper panel rests in place on the lower panel on the shims 16. The grout is then allowed to harden in order to form a strong, rigid connection between the two panels. Grout extends into the grout recesses on the inside of the bodies 22 to form connections with the lower panel. The grout also engages the roughness on the surface of rods 52 to form a strong connection with the rod and with the upper panel 12.

After the grout is fully set the connections 10 form high strength concealed joints between the two vertically mounted panels 12 and 14. These connections are completely confined within the thickness of the panel and do not project beyond the panel side walls. If desired, this horizontal space between the panels may be caulked or pointed.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A tube member for use in a connection joining precast concrete panels or the like, the member including an integral elongate, imperforate and hollow tubular body having a first closed end and a second end, concrete-engaging recesses formed in the outside of the body, grout-engaging recesses formed in the inside of the body, and form-attachment means at the second end of the body for removably securing the body to a panel-casting form; and a transparent seal member secured to the second end of the body, the seal member overlying and closing the second end of the body.

2. A member as in claim 1 wherein the recesses in the outside of the body are located between the recesses in the inside of the body.

3. A member as in claim 2 wherein the recesses in one side of the body are circumferentially discontinuous and the recesses in the other side of the body are circumferentially continuous.

4. A member as in claim 2 wherein the form-attachment means comprises a circumferential flange integral with the body, the flange extending radially outwardly of the body at the second end.

5. A member as in claim 1 wherein the body is formed from a generally cylindrical seam-free plastic tube, said first end comprising an integral, seam-free and smoothly rounded portion of the plastic tube, the form attachment means comprising an outwardly extending circumferential flange integral with said plastic tube, the seal member being secured to the flange.

6. A member as in claim 5 wherein the recesses in one side of the body are circumferentially discontinuous and the recesses in the other side of the body are circumferentially continuous.

7. A member as in claim 5 wherein the interior and exterior surfaces of the first end are smoothly rounded from the tip of the body to the cylindrical wall thereof.

8. A member as in claim 4 wherein the seal is a sheet and including a waterproof joint securing the sheet to the top of the flange.

9. A member as in claim 1 wherein said body is molded from an integral mass of thermoplastic resin, the recesses in the outside of the body are located between the recesses located in the inside of the body, and the form-attachment means comprises a flange extending outwardly from the second end of the body.

10. A member as in claim 9 wherein said seal is integral with the body.

11. A member as in claim 10 wherein the first end of the body is rounded.

12. A member for use in a connection joining precast concrete panels or the like, the member including an elongate hollow and imperforate tubular body formed of plastic resin having opposed ends; a transparent wall sealed to one end of the body to overlie the interior of the body and close the one end, such wall, when ruptured or removed, permitting filling of the interior of the body with grout and insertion of a reinforcing bar into the grout within the interior of the body for forming a connection therewith, concrete-engaging recesses formed in the outside of the body, grout-engaging recesses formed in the inside of the body, and form-attachment means integral with the body at the one closed end of the body for removably securing the body to a panel-casting form.

13. A member as in claim 12 wherein the other end of the body is rounded.

14. A member as in claim 13 wherein the interior of the body above the other end is smooth.

15. A member as in claim 14 wherein said form-attachment means comprises a circumferential flange extending around the body at the one end.

16. A member as in claim 12 wherein the body comprises an integral mass of plastic resin.

17. A structure comprising a lower precast concrete member, an upper precast concrete member resting on top of the lower member and a connection joining the members together, the connection including an integral elongate tubular plastic body embedded in the top of the lower member with the body having an open end facing the upper member, a flange at the open end, a closed end facing away from the upper member, a plurality of concrete-engaging recesses on the outside of the body, a plurality of grout-engaging recesses on the inside of the body; concrete in the lower member extending into the concrete-engaging recesses; grout filling the interior of the body and extending into the grout-engaging recesses; a rod embedded in the upper member, said rod extending downwardly through the open end of the body and into the grout in the body to form a connection therewith; and an opened transparent seal at the end of the body surrounding the rod.

18. A structure as in claim 17 wherein the closed end of the body is rounded.

19. A structure as in claim 18 wherein the inside of the body is smooth above the closed end.

20. A structure as in claim 17 including a flange integral with the body surrounding the open end of the body.

21. A tube member for use in a connection joining precast concrete panels or the like, the member including an integral elongate, imperforate and hollow tubular body having a first closed end and a second end, concrete engaging recesses formed in the outside of the body, grout-engaging recesses formed in the inside of the body, the recesses in one side of the body being circumferentially discontinuous and the recesses in the other side of the body being circumferentially continuous, and form-attachment means at the second end of the body for removably securing the body to a panel-casting form; and a seal overlying and closing the second end of the body.

* * * * *